United States Patent [19]

Catenacci

[11] 4,101,237

[45] Jul. 18, 1978

[54] METHOD OF SLIP-FORMING ROADBEDS AND APPARATUS THEREFOR

[76] Inventor: Gerald Anthony Catenacci, 44 Golfvalley La., Toronto, Canada

[21] Appl. No.: 825,129

[22] Filed: Aug. 16, 1977

[51] Int. Cl.[2] ..... E01C 11/28

[52] U.S. Cl. ..... 404/98; 404/105

[58] Field of Search ..... 404/98, 105, 108, 83, 404/84, 118, 104

[56] References Cited

U.S. PATENT DOCUMENTS

| | | | |
|---|---|---|---|
| 1,467,243 | 9/1923 | Fitzgerald | 404/98 |
| 1,619,083 | 3/1927 | Maxon | 404/98 |
| 1,990,931 | 2/1935 | Colbert | 404/98 |
| 2,587,321 | 2/1952 | Hohnke | 404/98 |
| 2,881,683 | 4/1959 | Konway | 404/98 |
| 3,098,414 | 7/1963 | Guntert | 404/105 |
| 3,202,068 | 8/1965 | Larsen | 404/98 |
| 3,377,933 | 4/1968 | Dale | 404/98 |
| 3,856,425 | 12/1974 | Miller | 404/165 X |

*Primary Examiner*—Nile C. Byers

[57] ABSTRACT

A roadbed and a curb are formed as a single integral structure by slip-forming concrete material using a tracked vehicle supporting a roadbed slip-form and a curb slip-form which extend along opposite sides of a track of the vehicle so leaving a gap between the formed roadbed and curb to allow passage of the vehicle track. A filler portion of concrete material passes rearwardly through a passageway in the roadbed slip-form above the final top surface of the roadbed and such filler portion of concrete material is transferred transversely outwardly to fill such a gap rearwardly of the vehicle track. Finally, the top surface of the material so transferred and that of the roadbed from where such material was transferred are smoothed.

16 Claims, 8 Drawing Figures

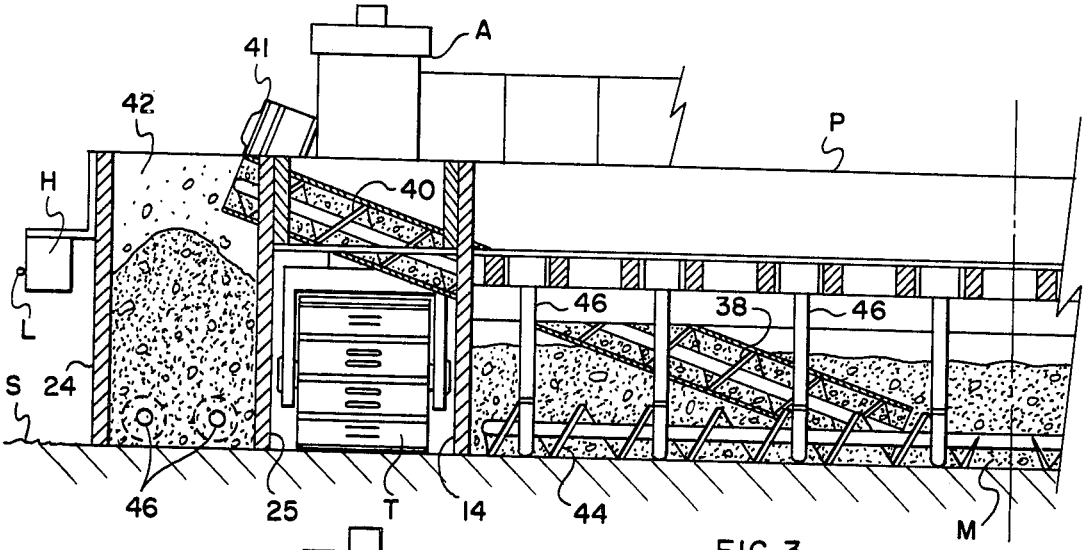
FIG 3
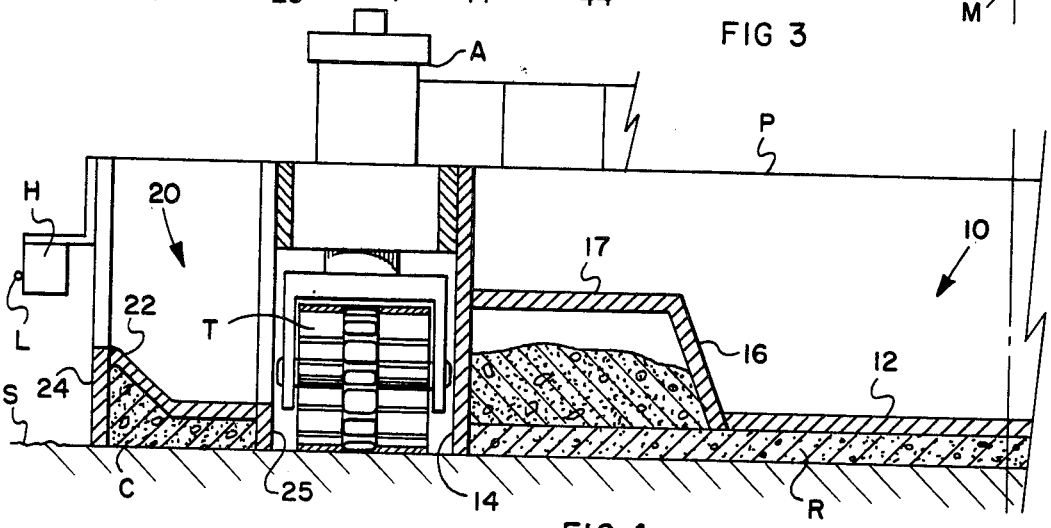
FIG 4
FIG 5
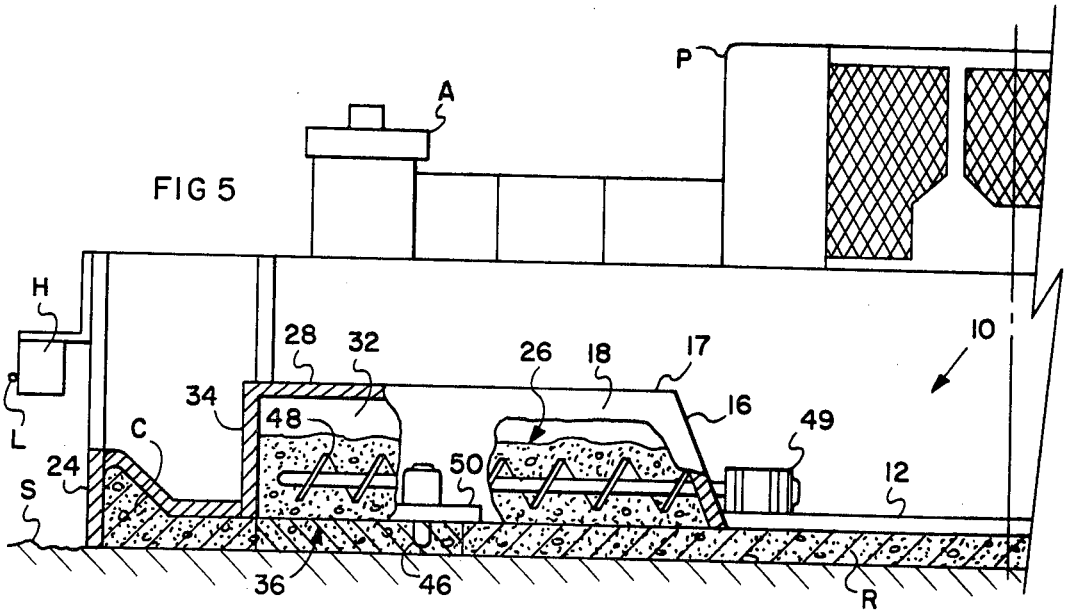

METHOD OF SLIP-FORMING ROADBEDS AND APPARATUS THEREFOR

The present invention relates to a method of slip-forming a roadbed and a curb or curbs of concrete material and to slip-forming apparatus for carrying out such a method.

Slip-forming, i.e., the use of formwork carried by a moving structure or platform is widely used for the laying of concrete roadbeds and is also used for forming curbs. Such moving platforms are usually supported on some form of motorized supports, such as tracks, wheels and the like. The width of a concrete roadbed that can be laid down by such an apparatus is usually determined by the space between the tracks or wheels of such apparatus. Where the road site is unobstructed on both sides, it is of course possible to separate the tracks of the apparatus far enough apart for the slip-form to shape both the curbs and the roadbed itself simultaneously in a single pass.

However, in many locations, such as, for example, in city streets, the roadway will be obstructed on one side or the other. In such cases, existing slip-forming methods require that the track portions of the platform run at least partly in the location where the curbs or the roadbed will eventually be formed. After the roadbed has been formed, there will then be two spaces, one on either side and separate slip-forming equipment must then be driven along the roadbed itself to slip-form the curbs or even other parts of the roadbed.

This known procedure involves three separate operations or passes instead of one and also means that the roadbed and curbs are formed with breaks or spaces between them and are not a single integral structure. This of course leads to inherent weakness and water, salt and the like can enter into such openings and damage the concrete, making the final structure less durable.

It is clearly, therefore, desirable to form the roadbed and curbs in a single pass, both from the viewpoint of efficiency and economy and also from the viewpoint of durability.

SUMMARY OF THE INVENTION

The present invention therefore seeks to overcome the foregoing disadvantages by the provision of a method of slip-forming a roadbed and at least one integral curb by the steps of (a) moving a roadbed slip-form along one side of a trackway and simultaneously moving a curb slip-form along an opposite side of said track way, said roadbed slip-form and said curb slip-form being mutually spaced apart by a distance equalling at least the width of said trackway, (b) continuously depositing concrete material in front of both said roadbed slip-form and said curb slip-form whereby movement of said slip-forms over said concrete material will shape and form said concrete material into a roadbed and a curb, said roadbed and said curb so formed being mutually spaced apart by a predetermined gap, (c) continuously passing a filler portion of concrete material through one of said roadbed slip-form and said curb slip-form, said filler portion of concrete material being disposed on the top surface of concrete material formed by a respective one of said slip-forms and being located generally along one edge of and on one of said roadbed and said curb adjacent said gap, (d) continuously transferring said filler portion of concrete material transversely into said gap thereby filling said gap to join said curb and said roadbed to form a single integral homogeneous concrete structure, and (e) continuously smoothing the top surface of said concrete material as transferred into said gap and the top surface of that one of said curb and said roadbed from which said filler portion was transferred.

In general, the continuous deposition of concrete material in front of the curb slip-form will be effected by continuously transferring concrete material into such position from its position as dumped or deposited in front of the roadbed slip-form. Such transfer of concrete material is usefully effected over said trackway, for example, by the use of an elevator.

The method according to the invention further envisages the forming of two curbs on opposite sides of a roadbed in the same way simultaneously.

Preferably, in accordance with this invention the filler portion of concrete is located initially on said roadbed and is transferred from such location on such roadbed into the gap between the roadbed and the curb.

The method according to the invention usefully further comprises the continuous rearranging of concrete material as deposited in front of the roadbed slip-form so as to obtain a more or less even distribution thereof and so as to ensure that sufficient concrete material is distributed or transferred toward at least one side of the roadbed so that some of such concrete material may be conveyed over the space occupied by the track portions of the platform and into the slip-form for the curb and so that, in addition, a sufficient excess of concrete material is available at the edge of the roadbed so that it may subsequently be transferred therefrom for filling the gap left by the corresponding track portion.

The invention also provides an apparatus for carrying out the aforementioned objectives. Such apparatus can broadly be defined as comprising transversely spaced apart support means movable in a longitudinal direction along a roadway sub-surface; a roadbed slip-form extending transversely between said support means, supported thereby and adapted to shape and form fluid concrete material as deposited in front thereof into a roadbed having a top surface; a curb slip-form located transversely adjacent a first one of said support means and supported thereby so as to be spaced apart transversely relative to said roadbed slip-form by a gap having a width at least equal to the width of said first one of said support means and adapted to shape and form fluid concrete material as deposited in front thereof into a curb having a top surface; a rearward passage for continuously passing a filler portion of concrete material through one of said roadbed slip-form and said curb slip-form, said filler portion of concrete material being disposed on the top surface of a respective one of said roadbed and said curb; a transverse transfer means for transferring such a filler portion of concrete material into said gap rearwardly of said first one of said support means; and smoothing means supported by said support means and adapted to smooth both the top surface of said concrete material as transferred into said gap and the top surface of that one of said curb and said roadbed from which said filler portion was transferred.

An apparatus in accordance with this invention will generally also comprise a transfer feed means supported by said support means and adapted to transfer concrete material from a position in front of said roadbed slip-form to a position in front of said curb slip-form. Such a transfer feed means is usefully in the form of an elevator adapted to transfer concrete material transversely outwardly to said curb slip-form over the path of said first one of said support means.

The invention further provides that the apparatus may be provided with curb slip-forms at both sides thereof and usefully with transfer feed means for conveying concrete material to both curb slip-forms simultaneously.

The apparatus according to the invention will of course normally be provided with a suitable guidance and height adjustment system, as is provided in other such mobile platforms. Additionally, such an apparatus is preferably provided with concrete spreader or distributor means across its front so that concrete material may be dumped in front of the platform and then spread outwardly to both sides.

In addition, the usual concrete vibrators will be incorporated at various points so as to ensure free movement of the concrete material and complete filling of the slip-forms.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

The invention will now be described merely by way of illustration with reference to the accompanying drawings, in which:

FIG. 3 is a vertical section along the line 3—3 of FIG. 2;

FIG. 4 is a vertical section along the line 4—4 of FIG. 2;

FIG. 5 is a vertical section along the line 5—5 of FIG. 2; and

DESCRIPTION OF THE PREFERRED EMBODIMENT

Figure 6A:
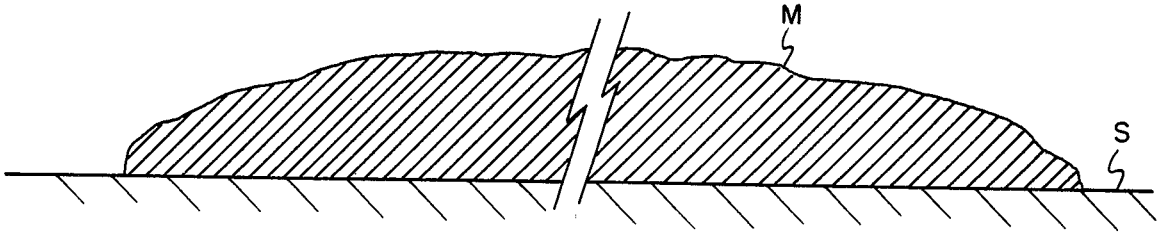
FIGS. 6*a*, 6*b* and 6*c* are schematic views showing three steps in the method according to the invention.
Figure 6B:
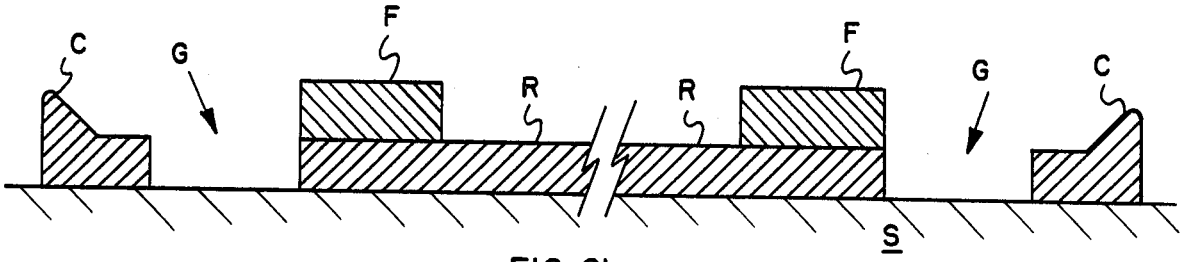
Figure 6C:
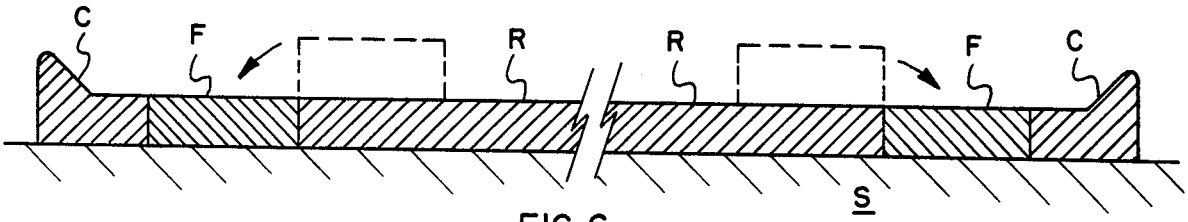

In FIGS. 6*a*, 6*b* and 6*c*, the method according to the invention is illustrated schematically. In FIG. 6*a*, a mass M of fluid concrete material is shown as being deposited on a roadway sub-surface S.

In FIG. 6*b*, the mass of concrete material is shown as having been slip-formed to provide a central roadbed portion R and two curb portions C of concrete material on opposite sides of the roadbed portion R but spaced therefrom by gaps G. The gaps G have widths which correspond more or less to the widths of the spaced apart support means of the apparatus used for slip-forming the roadbed R and the curbs C and which will be described in more detail below. Two filler portions F of concrete material formed by depositing an excess of concrete on top of the central roadbed portion R, along both sides thereof, are provided, being generally sufficient to fill respective ones of the gaps G.

In FIG. 6*c*, the final step of the method according to the invention is shown. In that step, the two filler portions F of concrete material are transferred from their positions on top of the roadbed R into the gaps G.

Figure 1:
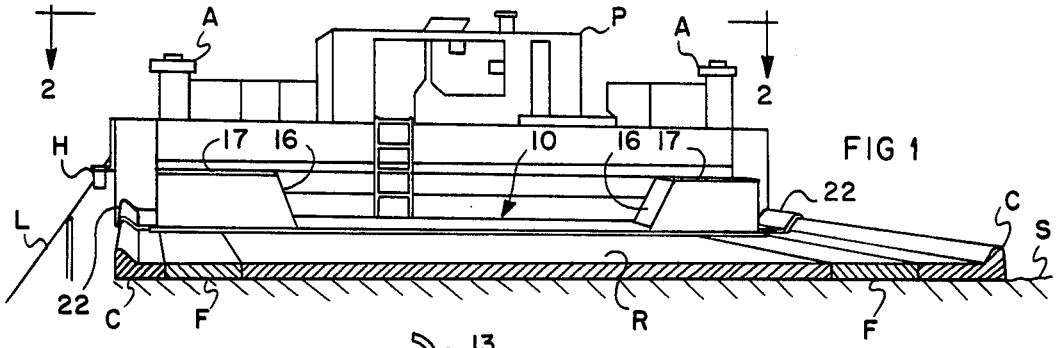
FIG. 1 is a schematic perspective illustration showing one embodiment of a slip-forming apparatus in accordance with this invention.

Reference will now be made to FIG. 1 which shows one embodiment of an apparatus according to the invention. That apparatus which is essentially a very large vehicle, having suitable mobile support means, typically track or crawler type support means T carrying vertically adjustable columns A, typically hydraulic cylinders which support a platform P, will normally be provided with any suitable drive and transmission means (not shown). The height and direction of the platform P are controlled by means of a guideline L supported on suitable pegs alongside the road sub-surface S. One or more guide heads H may be mounted on the side of the platform P for following the line L. Such guide heads H may simply provide a visual check of the position of the platform P. Alternatively, automatic sensing means may be provided for sensing any deviation of the platform P from the line L and for causing suitable adjustments to either height or direction to be made automatically in a manner known in the art.

Referring now to FIGS. 2, 3, 4 and 5, the platform P will be seen to be provided with a central roadbed slip-form 10 which is located between the tracks T of the platform P.

The slip-form 10 comprises an upper wall portion 12, front guide walls 13 extending forwardly and more or less vertical side walls 14 extending rearwardly on opposite transverse sides thereof. In order to provide a passageway for passage of the filler portions F, angular wall portions 16 and 17 are fastened between the top wall 12 and the side walls 14 on both sides of the roadbed slip-form 10. The angular wall portions 16 and 17 will be seen to provide generally upwardly projecting box-like enclosures having open bottoms communicating with the lower portion of the slip-form 10 so that the filler portions F of concrete material may pass therethrough above the general level of the roadbed R.

It may also be desirable to provide guard walls or baffles (not shown) in front of the leading tracks T to keep this area free of concrete but in most cases this is not necessary.

The side walls 14 are located closely adjacent to the inner edges of the tracks T of the platform so that the roadbed may be slip-formed over the full transverse extent of the space between the tracks T.

The passage-forming wall portions 16 and 17 are somewhat shorter than the length of the top wall 12 of the slip-form 10, and are closed off at their rear ends by end walls 18. It will be noted that the lengths of the walls 16 and 17 are such as to extend somewhat beyond the rearmost limit of the rearward track T of the platform, so that the filler portion of concrete material is carried to a position rearward of that rearward track T.

In order to slip-form the curb C, curb slip-forms shown generally at 20 are provided on opposite transverse sides of the platform P, such curb slip-forms being located transversely outwardly with respect to the tracks T. Such a curb slip-form 20 will be seen to comprise an upper or top wall 22 and outer and inner side walls 24 and 25 respectively. The shape of the upper wall 22 may be such as to provide any suitable curb profile depending upon the requirements of the particular highway being constructed. Some such curb profiles provide simply a generally concave gutter shape while other such curb profiles provide a shape as shown, the precise shaping of the curb, however, forming no part of the present invention.

The curb slip-forms 20 also extend rearwardly of the rearmost tracks T of the platform P.

A transverse transfer passage 26 consisting of an upper wall 28 and two transverse side walls 32 extends from the angular wall portions 16 and 17 to a point adjacent the respective curb slip-form 20, being closed off at about its free end by means of an end wall 34.

The transfer passageway 26 thus leaves a generally rectangular downwardly directed port 36 through which the concrete material may be transferred downwardly into a respective one of the gaps G between the curb C and the roadbed R. Such ports 36 will thus be located more or less directly in line with the respective track T of the platform P as shown in the drawing.

As hereinbefore mentioned, in this particular embodiment of the present invention, the mass of concrete material M is initially deposited between the tracks T of the platform, the amount of such concrete material being sufficient both for slip-forming the roadbed R, the filler portions F and the curbs C.

In order to transfer concrete material from such mass into the curb forms 20, generally cylindrical tubular conveyor conduits 38 are mounted in front of the roadbed slip-form 10 so as to extend upwardly and outwardly at an angle with their inner ends being more or less at ground level and extending upwardly and outwardly over the tracks T. Within the conduits 38, any suitable conveyor means such as, for example, augers 40, are provided, which augers are driven by any suitable motor drive means 41 which may, for example, be hydraulic or pneumatic. Operation of the augers 40 will cause a portion of the concrete mass M to be driven up the conduits 38 and over the tracks T and to be ejected from the upper ends of the conduits over the curb slip-forms 20. The curb slip-forms 20 are preferably provided with hoppers 42 located more or less directly beneath the upper ends of the conduits 38 so as to catch concrete material falling therefrom and to feed it downwardly into the curb slip-forms 20.

Figure 2:
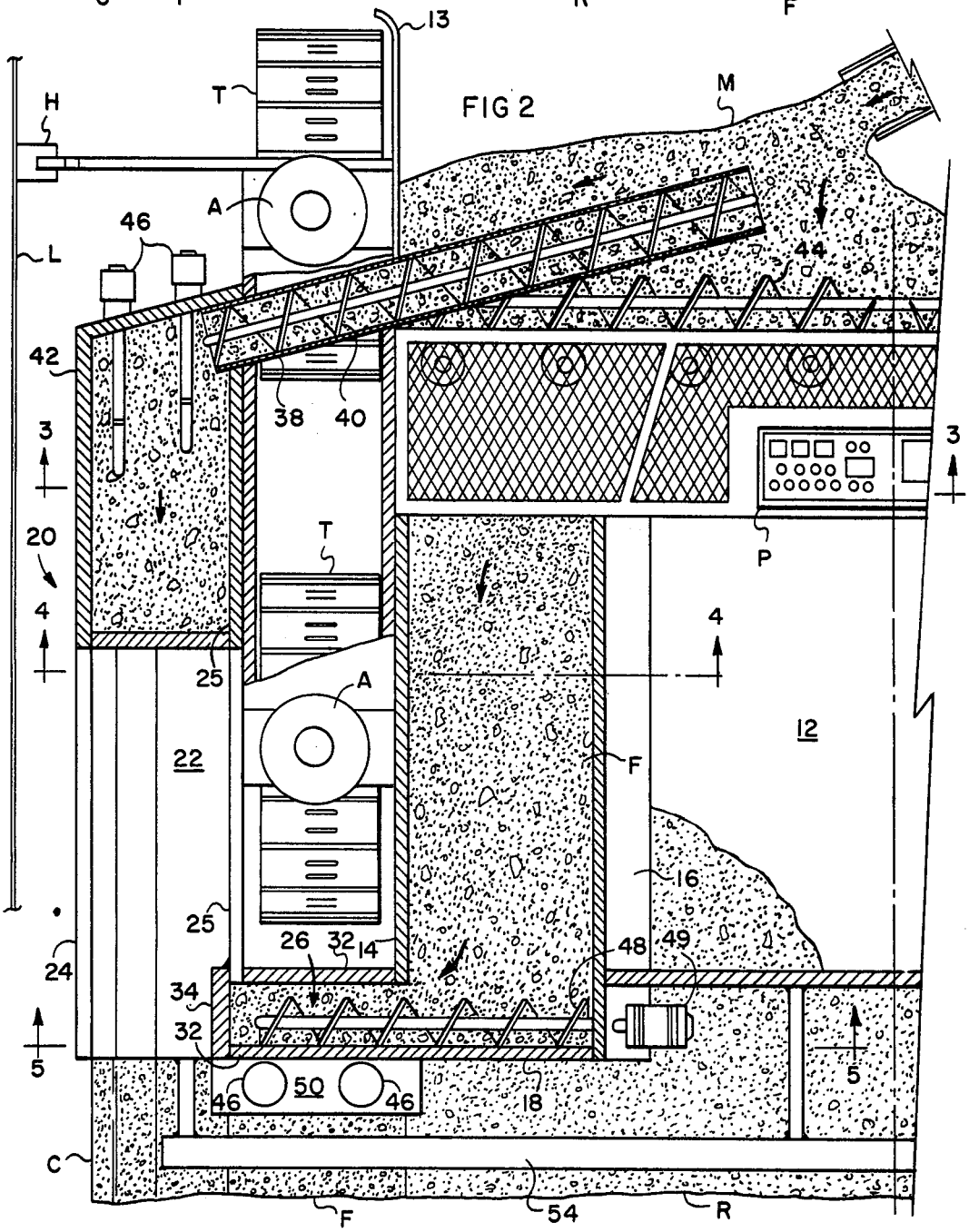
FIG. 2 is a top plan view of one side of the slip-forming apparatus shown in FIG. 1 when taken as indicated by the arrows 2—2 of that figure and with certain parts cut away to reveal underlying structure.

Preferably, means will also be provided for distributing the concrete material evenly in front of the roadbed slip-form 10. In FIG. 2, augers 44 located more or less in a horizontal transverse manner in front of the slip-form 10 are shown as being provided for such purpose. The augers 44 may, in fact, be mounted on a single shaft and comprise helical spiral members wound in opposite directions so that, upon rotation of the shaft, concrete will be spread from the centre outwardly in both directions. Such a shaft would be driven by any suitable motor means (not shown) such as are well known in the art.

Any suitable concrete vibrator means 46 may be located at various points in the slip-forms 10 and 20 and driven by any suitable motor means (not shown) such as are well known in the art and require no further description herein.

In order to provide transfer of the concrete filler portions F from their initial locations above the edges of the roadbed R into the gaps G, transfer auger means 48 are provided within the transfer passageways 26 and such auger means 48 can be driven by any suitable motor means 49 such as are well known in the art. Such auger means 48 will be operable to move the filler portions of concrete material transversely outwardly through the passageways 26 so that such portions then drop downwardly through the ports 36 into the gaps G.

Horizontal top walls 50 extend rearwardly from passageways 36 for smoothing the top surface of the filler concrete. Smoothing bars 54 may also be added at the rear of top wall 12 for smoothing the surface of roadbed R.

In operation, the mass M of concrete material is deposited in front of the roadbed slip-form 10 from a truck, the platform P is set in motion forwardly and the various augers and motors and vibrators are started. The concrete material is distributed toward the sides of the slip-form 10 continuously by operation of the augers 44 and some of the concrete material is transferred continuously upwardly through the conduits 38 by the augers 40, so that some concrete is continuously transferred over the paths of the tracks T and deposited in the hoppers 42 of the curb slip-forms 20. If desired, of course, concrete material may initially be placed in the hoppers 42 by hand so that the forward movement of the platform will simultaneously commence slip-forming both of the roadbed R and the curbs C at the same position.

Some of the concrete material will pass directly under the top wall 12 of the roadbed slip-form 10 so as to be shaped and formed into the actual surface of the roadbed R.

Excess concrete material will pass through the passageway defined by the walls 14, 16 and 17 above the roadbed R so as essentially to be disposed above that roadbed.

The front walls 13 and side walls 14 and 25 prevent concrete from entering beneath the tracks T with the result that the gaps G are formed along either side of the roadbed R.

Simultaneously with the slip-forming of the roadbed R, the curbs C are of course being continuously slip-formed as the platform P moves forwardly, by passage of portions of the concrete material through the curb slip-forms 20.

The filler portions of concrete material finally reach the transfer passageways 26 and are then moved transversely outwardly relative to the roadbed R by the augers 48 in the passageways 26 until such filler portions reach the downwardly directed ports 36, at which point such material will drop downwardly into the gaps G formed between the roadbed R and the curbs C. The upper surface of such excess concrete is then smoothed and slip-formed by the upper walls 50 which extend rearwardly with respect to the passageway 26 and also by bars 54, so as to smooth the entire surface of the roadbed from side to side between the curbs C.

If desired, any suitable form of vibratory or rotary finishing devices (not shown) of a type well known in the art may be incorporated in both the roadbed slip-form 10 and the curb slip-forms 20 so as to provide a smooth finished appearance. Alternatively, the surface may be hand-trowelled or finished by manually held machines in any suitable manner.

The profile of the curbs C will, generally speaking, be such that, provided a suitable form of low-slump concrete is used, they will not sag or collapse after they leave the curb slip-forms 20.

Clearly, it would also be possible, if the curbs C were sufficiently wide, to pass the filler portions F of concrete material through suitable passages provided on top of the curbs. Such filler portions of concrete material would then be moved transversely inwardly into the gaps G provided for the tracks T, in essentially the same way as hereinbefore described. Such an alternative arrangement is not, therefore, to be regarded as being excluded from the scope of the invention. The terms "roadbed" and "curb" as used herein are not intended to exclude such an alternate form of operation, although the mode as illustrated herein is believed to be convenient and effective in practice.

The foregoing is a description of a preferred embodiment of the invention which is given here by way of example only. The invention is not to be taken as limited to any of the specific features as described, but comprehends all such variations thereof as come with in the scope of the appended claims.

What is claimed is:

1. A method of slip-forming a roadbed and at least one integral curb from fluid concrete material and which method comprises the steps of:

a. moving a roadbed slip-form along one side of a trackway and simultaneously moving a curb slip-form along an opposite side of said trackway, said roadbed slip-form and said curb slip-form being mutually spaced apart by a distance equalling at least the width of said trackway;

b. continuously depositing concrete material in front of both said roadbed slip-form and said curb slip-form whereby movement of said slip-forms over said concrete material will shape and form said concrete material into a roadbed and a curb, said roadbed and said curb so formed being mutually spaced apart by a predetermined gap;

c. continuously passing a filler portion of concrete material through one of said roadbed slip-form and said curb slip-form, said filler portion of concrete material being disposed on the top surface of concrete material formed by a respective one of said slip-forms and being located generally along one edge of and on one of said roadbed and said curb adjacent said gap;

d. continuously transferring said filler portion of concrete material transversely into said gap thereby filling said gap to join said curb and said roadbed to form a single integral homogeneous concrete structure; and e. continuously smoothing the top surface of said concrete material as transferred into said gap and the top surface of that one of said curb and said roadbed from which said filler portion was transferred.

2. A method as claimed in claim 1 and which comprises passing said filler portion of concrete material through said roadbed slip-form and continuously transferring said filler portion of concrete material transversely outwardly into said gap.

3. A method as claimed in claim 2 and in which said concrete material is continuously deposited in front of said curb slip-form by continuously transferring concrete material thereto from its position as deposited in front of said roadbed slip-form.

4. A method as claimed in claim 3 and in which said continuous transfer of concrete material into a position in front of said curb slip-form is effected over said trackway.

5. A method as claimed in claim 4 in which curbs are simultaneously formed along both sides of said roadbed and which method includes the steps of:

a. continuously forming both said curbs in positions transversely spaced apart from said roadbed by a respective said gap;

b. continuously passing a said filler portion of concrete material through said roadbed slip-form generally along each transverse edge thereof adjacent a respective said gap;

c. continuously transferring said filler portions transversely outwardly into respective ones of said gaps thereby filling said gaps to join said curbs and said roadbed to form a single integral homogeneous concrete structure; and d. continuously smoothing the top surface of said concrete material as transferred into said gaps and at least those portions of the top surface of said roadbed from which said filler portions were transferred.

6. A method as claimed in claim 4 and in which said continuous transfer of said filler portion of said concrete material is effected by moving said concrete material of said filler portion transversely outwardly relative to said roadbed and then downwardly into said gap.

7. A method as claimed in claim 6 and which comprises the additional step of continuously rearranging said concrete material as deposited in front of said roadbed slip-form so as to move sufficient said material transversely outwardly for establishment of said filler portion.

8. Concrete slip-forming apparatus for the slip-forming of a roadbed and at least one curb as a single integral homogeneous concrete structure and which apparatus comprises:

transversely spaced apart support means movable in a longitudinal direction along a roadway sub-surface;

a roadbed slip-form extending transversely between said support means, supported thereby and adapted to shape and form fluid concrete material as deposited in front thereof into a roadbed having a top surface;

a curb slip-form located transversely adjacent a first one of said support means and supported thereby so as to be spaced apart transversely relative to said roadbed slip-form by a gap having a width at least equal to the width of said first one of said support means and adapted to shape and form fluid concrete material as deposited in front thereof into a curb having a top surface;

a rearward passage for continuously passing a filler portion of concrete material through one of said roadbed slip-form and said curb slip-form, said filler portion of concrete material being disposed on the top surface of a respective one of said roadbed and said curb;

a transverse transfer means for transferring such a filler portion of concrete material into said gap rearwardly of said first one of said support means; and smoothing means supported by said support means and adapted to smooth both the top surface of said concrete material as transferred into said gap and the top surface of that one of said curb and said roadbed from which said filler portion was transferred.

9. Concrete slip-forming apparatus as claimed in claim 8 and in which said rearward passage for continuously passing a filler portion of concrete material is provided in said roadbed slip-form generally along one longitudinal edge of said gap.

10. Concrete slip-forming apparatus as claimed in claim 9 and in which said rearward passage is in the form of an upward extension of said roadbed slip-form.

11. Concrete slip-forming apparatus as claimed in claim 10 and in which said transverse transfer means comprises a transverse passage opening into said rearward passage to receive concrete material therefrom and drive means for moving such concrete material through said transverse passage for deposition in such a gap between said roadbed and said curb.

12. Concrete slip-forming apparatus as claimed in claim 11 and in which said drive means comprises an auger disposed within said transverse passage.

13. Concrete slip-forming apparatus as claimed in claim 11 and which additionally comprises transfer feed means supported by said support means and adapted to transfer fluid concrete material from a position in front of said roadbed slip-form to a position in front of said curb slip-form.

14. Concrete slip-forming apparatus as claimed in claim 13 and in which said transfer feed means is adapted to transfer fluid concrete material to said curb slip-form over the path of said first one of said support means.

15. Concrete slip-forming apparatus as claimed in claim 14, which comprises two said curb slip-forms located transversely adjacent respective ones of said support means so as to be spaced apart transversely outwardly relative to said roadbed by gaps having widths at least equal to the widths of respective ones of said support means, two said rearward passages for continuously passing filler portions of concrete material through said roadbed slip-form; and two said transverse transfer means for transferring such filler portions of concrete material transversely outwardly into respective ones of said gaps rearwardly of respective ones of said support means, and in which said smoothing means is adapted to smooth the top surfaces of said concrete material as transferred into both said gaps and the top surface of said roadbed from which said filler portions were transferred.

16. Concrete slip-forming apparatus as claimed in claim 14 and which additionally comprises concrete-distributing means for transferring fluid concrete material transversely across a front end of said roadbed slip-form.

* * * * *